United States Patent [19]

Adis et al.

[11] Patent Number: 4,604,104

[45] Date of Patent: Aug. 5, 1986

[54] OIL GASIFYING BURNER WITH AN OIL ATOMIZER

[75] Inventors: Erich Adis, HN-Biberach; Manfred Bader; Winfried Buschulte, both of Neuenstadt, all of Fed. Rep. of Germany

[73] Assignee: Deutsche Forschungs- und Versuchsanstalt für Luft- und Raumfahrt e.V., Bonn, Fed. Rep. of Germany

[21] Appl. No.: 548,836

[22] Filed: Nov. 4, 1983

[30] Foreign Application Priority Data

Nov. 11, 1982 [DE] Fed. Rep. of Germany ..... 3241730

[51] Int. Cl.[4] ..... F23D 14/62; F23D 14/70

[52] U.S. Cl. ..... 48/107; 431/116; 431/353

[58] Field of Search ..... 48/107; 431/115, 116, 431/352, 353

[56] References Cited

U.S. PATENT DOCUMENTS

| | | | |
|---|---|---|---|
| 2,424,765 | 8/1947 | McCollum | 431/116 |
| 2,857,961 | 10/1958 | Brown, III et al. | 431/116 |
| 3,685,977 | 8/1972 | Goodman | 48/107 |
| 3,981,142 | 9/1976 | Invin | 431/352 |
| 4,120,639 | 10/1978 | Thekdi et al. | 431/115 |
| 4,130,388 | 12/1978 | Flanagan | 431/116 |
| 4,308,007 | 12/1981 | Buschulte | 431/116 |
| 4,364,725 | 12/1982 | Buschulte | 431/116 |

FOREIGN PATENT DOCUMENTS

| | | |
|---|---|---|
| 0048438 | 9/1981 | European Pat. Off. . |
| 2918416 | 11/1980 | Fed. Rep. of Germany . |

*Primary Examiner*—Barry S. Richman
*Assistant Examiner*—Joye L. Woodard
*Attorney, Agent, or Firm*—Kenway & Jenney

[57] ABSTRACT

In a gasifying oil burner with an oil atomizing device, with combustion air supply means surrounding the atomizing device, with a shield having a shield opening, said shield being disposed downstream of the outlet of the atomizer, with a mixing tube disposed downstream of the outlet of the atomizer, with a mixing tube disposed downsteam of an co-axial with the shield opening, with a radial passage at an upstream portion of the mixing tube, with a generally cylindric flame tube whose upstream end is sealingly connected to the end wall of the combustion air supply means carrying the shield, and wherein it is proposed that the mixing tube be provided with a solid wall at a section thereof adjoining the shield, that the radial passage adjoin a part of the mixing tube provided with the solid wall, and that the axial length of the mixing tube portion with the solid wall extending between the shield and the radial passage be between the 0.1-multiple and the 0.6-multiple of the inside diameter of the mixing tube, in order to provide a soot-free burning of heating oil having a very high content of aromatic hydrocarbons and/or a surplus of fuel in a recirculation region.

6 Claims, 2 Drawing Figures

OIL GASIFYING BURNER WITH AN OIL ATOMIZER

BACKGROUND OF THE INVENTION

The invention relates to an oil gasifying burner with an oil atomizing device, a combustion air supply means, a shield with a shield opening disposed downstream of the outlet of the oil atomizer, a mixing tube co-axial with the shield opening and disposed downstream of same, a radial passage at the upstream portion of the mixing tube, and a substantially cylindric flame tube whose upstream located end is sealingly connected with the end wall of combustion air supply means, and wherein the mixing tube is substantially exposed.

Such an oil gasifying burner is known, for instance from DE-OS No. 29 18 416.

In this known arrangement, a spray formed by the oil atomizing device, particularly by a swirl-discharge nozzle, is injected in the combustion system and is simultaneously mixed with combustion air and carried together with same further into the combustion system by passing through a circular shield disposed at the upstream end of the combustion system and concentric with the axis of the nozzle. This mixture of oil droplets and combustion air then enters a mixing tube which is arranged downstream of the shield and which is provided, at its upstream end where it adjoins the shield plate, with openings through which heat recirculation gases are drawn by the injector effect of the combustion air stream, are mixed with same and utilized in vaporizing the fuel droplets. The velocity of the flow in the mixing tube of a known device is greater than the velocity of flame propagation so that no combustion can become stabilized therein. Thus, vaporization of the oil mist droplets is effected in this region solely due to a heat input.

When the flow of the mixture of combustion air and oil leaves the mixing tube, retardation of the flow is caused by the increase of the inside diameter. The velocity of flow transgresses, at a known distance from the mixing tube outlet, the velocity of the flame propagation so that the burning can be established therein.

Due to the suction effect of the injector flow of the combustion air through the shield, vacuum is generated outside the radial passages in the mixing tube at an annular space between the mixing tube and the flame tube downstream of the shield. This vacuum draws combustion gases from the downstream located region of the combustion. These gases are partly combustion gases after the reaction of oil and air, but partly still gaseous unburned oil and air. Altogether, a mixture content is formed in the recirculation space which contains a more or less substantial surplus of fuel. A high temperature in the recirculation space, which can be, for instance, between 870 and 1070K, gives rise to the breakup ("cracking") of same, particularly with a less stable molecular structure of aromatic hydrocarbons. A more frequent component under the cracking products is acetylenes which, besides, have the tendency to polymerize. Soot very easily results from acetylene. The soot formation is substantially lower with non-aromatic hydrocarbons.

The components of the combustion system disposed upstream of the shield such as the end wall supporting the shield, the shield support itself and also the combustion air supply tubes are intensively cooled by the flow of combustion air having approximately the room temperature. The flame tube and also the mixing tube in the known structures are in contact with the end wall or with the combustion air supply tube. Therefore, an intensive heat flow takes place from the combustion system and its components to the combustion air supply space and its components. In this region, therefore, the temperatures of the components decrease in the upstream direction.

Moreover, the oil combustion nozzles for the output region of about 65kW and up produce spray characteristics which are increasingly unsuitable for such a combustion system. Greater oil film thickness and higher conveying pressures required due to the fine atomization and thus greater droplet velocities leave the fuel surplus in the outer region of the flow of the mixing tube to be stronger. In this way, the operating conditions of the burner become impaired as the output class becomes higher.

Both effects lead to that deposits of soot accumulate first on the walls which deposits, on further decrease in the temperature, mix with condensated components of the heating oil having a higher boiling point and begin to form carbon at temperatures of about 600–700K. The rate of deposition is proportional to the rate of soot buildup in the recirculation region. This means that the rate of buildup on use of heating oil with a high content of aromatic substances is very much higher than with normal heating oils presently used. Besides, the rate increases with the increase in the output of the burner. Attempts in the field of use of heating oil with a high content of aromatic substances in the combustion system as referred to at the outset, lead in known structures to soot and carbon buildup rate so high that after a relatively short operation time of the range of 100 to 200 hours, the recirculation passages and partly also the shield passage diameter were reduced by the deposits to such a strong degree that the soot-free combustion was considerably impaired.

It is an object of the invention to improve an oil gasifying burner of this type such that the carbon and soot buildup in the recirculation chamber and in the region of the shield is reduced, particularly with heating oils having a very high content in aromatic hydrocarbons and/or with fuel surplus in the recirculation zone.

This object is solved in an oil gasifying burner of the type described at the outset such that the mixing tube is provided, at its portion adjoining directly the shield, with a solid wall, that the radial passage adjoins the said mixing tube portion with the solid wall and that the axial length of the mixing tube portion with the solid wall extending between the shield and the radial passage is between 0.1 to 0.6-multiple of the inside diameter of the mixing tube.

Experiments with such an arrangement have shown that by this modificaton of the known structures, the components of the device stay soot free, the temperature of the components is slightly increased in comparison with known structures, and, as a supplementary effect, a sizable reduction in the noise level in the flow tube occurs.

According to the present state of the art, the temperature increase of the components can be controlled by varying the length of the cylindric mixing tube portion between the shield and the radial passage.

The cylindric mixing portion upstream of the radial passage forms a dead space in the region between the shield edge, the shield wall and the mixing tube wall up to the radial passage into which the drive flow of combustion air and oil mixture entering through the shield draws hot recirculation gas. The temperature of the recirculation gas is higher and thus, it is flammable due to the content of the fuel surplus, when further air is admixed. This fresh air admixing is effected from the combustion air entering through the shield. It can therefore be assumed that by the reduction of velocity in the dead space between the shield and the mixing tube extension, a kind of a pilot flame is formed which brings about partial combustion of the fuel surplus contained in the recirculation gas.

The resulting temperature increase of the recirculation gases leads, after the admixing to the combustion air flow, to an increase in the temperature level of the drive flow. This aids, on the one hand, to the increase of the velocity of vaporization of the oil droplets and, on the other hand, it increases the temperature of the components, particularly of the portion of the mixing tube downstream of the radial passage, and it finally results in that the ignition of air-fuel flow leaving the discharge from the mixing tube is effected faster. The higher ignition quality of the mixture achieved by the temperature increase of the new structure leads to stabilization of the flame front.

In a preferred embodiment, it is provided that the end wall in the region between the mixing tube and the flame tube is offset in downstream direction with respect to the shield. Preferably, the offset end wall region is disposed in the same plane as the upstream disposed limit of the radial passage. Thus, on the one hand, the conditions under which deposits accumulate in the said dead space outside the mixing tube are removed. On the other hand, the upstream surface of the offset wall section will be less subject to the cooling effect of the air flowing in through the shield so that, similarly, the occurence of the deposit formation is inhibited.

In a further preferred embodiment, it is provided that the inside diameter of the mixing tube section, located between the shield and the radial passage, differs from that of the mixing tube portion disposed downstream of the radial passage, namely the inside diameter of the mixing tube portion located upstream is greater than that of a portion of the mixing tube located downstream of the passage. By varying the spacing between the shield and the passage on the one hand, and the inside diameter of the mixing tube section located upstream, on the other hand, the volume of the dead space inside the mixing tube extension can be varied and adjusted to suit particular operational conditions.

The end wall can be provided at its upstream facing surface with a heat insulating layer. By selecting the insulation material and thickness of the layer, the temperature for the wall best suited for the operation can be achieved.

BRIEF DESCRIPTION OF THE DRAWINGS

The following description of preferred embodiments of the invention will serve the purpose of further explanation, in conjunction with the drawing. In the drawing.

DETAILED DESCRIPTION OF THE DRAWINGS

Figure 1:
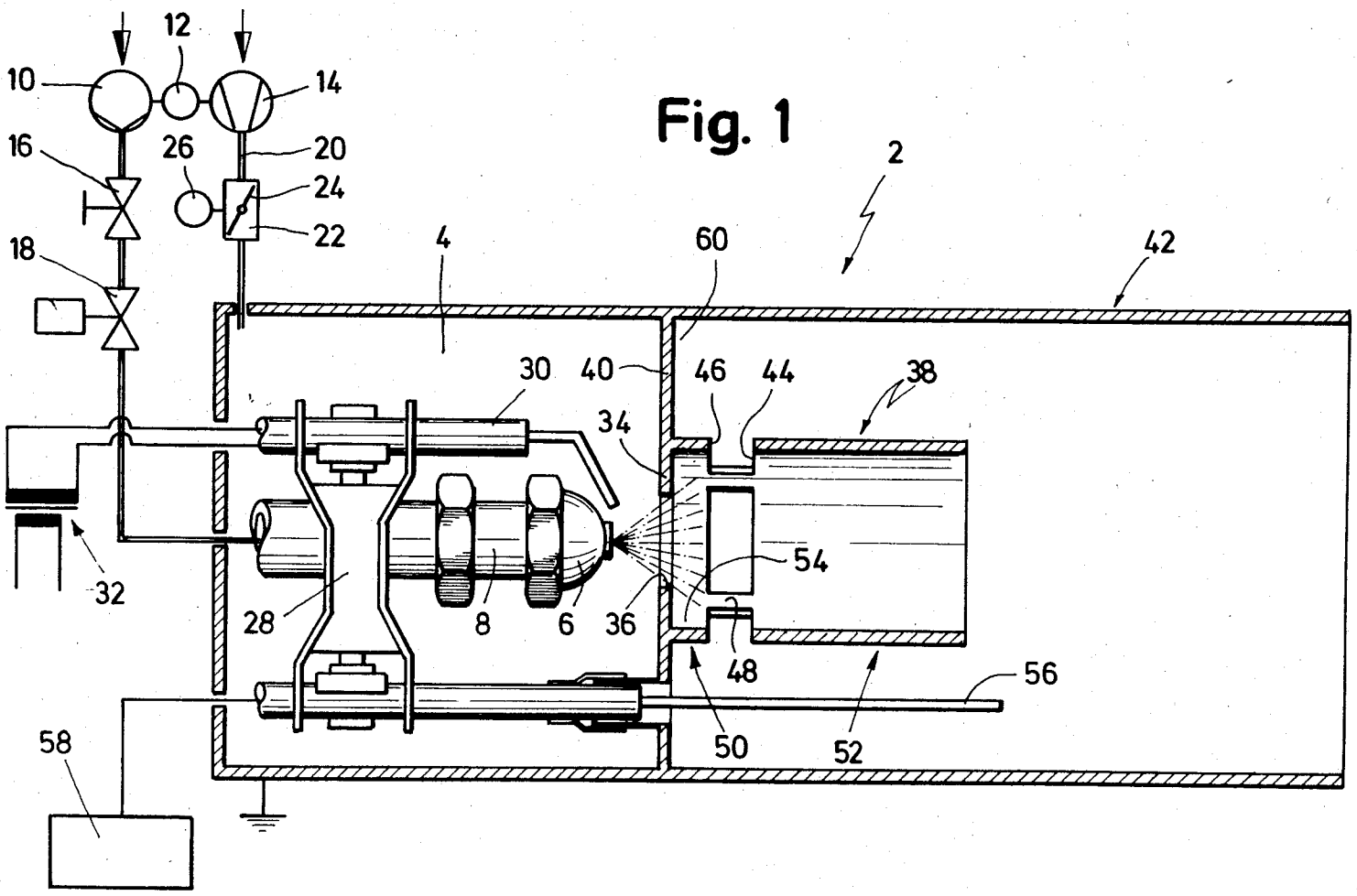
FIG. 1 is a diagrammatic longitudinal section of an oil gasifying burner according to the invention.

The oil gasifying burner 2 is provided with a chamber 4 in which a swirl-discharge nozzle 6 is supported in the usual way on the nozzle assembly 8. Oil is supplied by an oil pump 10 driven by an electric motor 12 which simultaneously drives a blower rotor 14. The oil pump conveys oil over an adjustable throttle valve 16 and an electromagnetically actuated shut-off valve 18, to the nozzle assembly 8 reaching to the atomizing nozzle. The blower rotor 14 drives combustion air through an air channel 20 into the chamber 4, namely over a throttle valve 22 with an air flap 24 which is adjustable by a motor 26. A pair of ignition electrodes 30, which is connected to an ignition transformer 32, is held by a holder 28 arranged on the nozzle assembly 8.

Before the orifice of the atomizer nozzle 6 is a shield wall 34 structured as a shield, having a shield opening 36. The shield opening 36 is coaxial with the axis of the atomizer nozzle 6. Downstream of the shield opening 36 is arranged a mixing tube 8, also coaxial with the axis of the atomizer nozzle 6, the tube being coaxially arranged in a flame tube 42 whose upstream end is sealingly connected with an end wall. The end wall 40 blends into the shield wall 34 and separates the chamber 4 from the burner chamber surrounded by the flame tube.

The diameter of the shield passage 36 is smaller than the inside diameter of the mixing tube 38.

Radial passages 44 are arranged in the wall of the mixing tube 38. The upstream disposed limitation 46 of the passages 44 are at a spacing from the shield wall 34, the spacing being between 0.1 and 0.6-times the inside diameter of the mixing tube 38. The radial passage 44 is formed by peripheral slots between which a number of cross-pieces 48 is maintained, which connect to each other the upstream disposed mixing tube section 50 and the downstream arranged mixing tube portion 52.

In the embodiment shown in FIG. 1, the mixing tube portion 50 has the same inside diameter as the mixing tube portion 52. However, it is possible within the scope of the invention to select the inside diameter of the mixing tube portion 50 to be different from that of the mixing tube portion 52.

Furthermore, it is possible to alter the length of the mixing tube portion 50 in axial direction, namely, as mentioned, about between 0.1 and 0.6-times the inside diameter of the mixing tube. By varying the inside diameter and the length of the mixing tube portion 50, the volume and the geometrical measurements of the dead space 54 can be changed, the space being limited at one end by the limitation of the shield opening 36 and by the shield wall 34 surrounding the shield, and, at the other end, by the wall of the mixing tube portion 50. By this modification of the measures of this dead space 54, the arrangement can be adjusted to suit particular operational conditions.

Merely for the sake completeness, it is to be pointed out that an ionizing probe 56 is provided which passes through the end wall 40 and extends into the flame tube up to the flame region in the flame tube, and is connected in the usual way with a control device 58 by which the oil infeed is interrupted on extinguishing of the flame by closing the valve 18 and by disengaging the motor 12.

Figure 2:
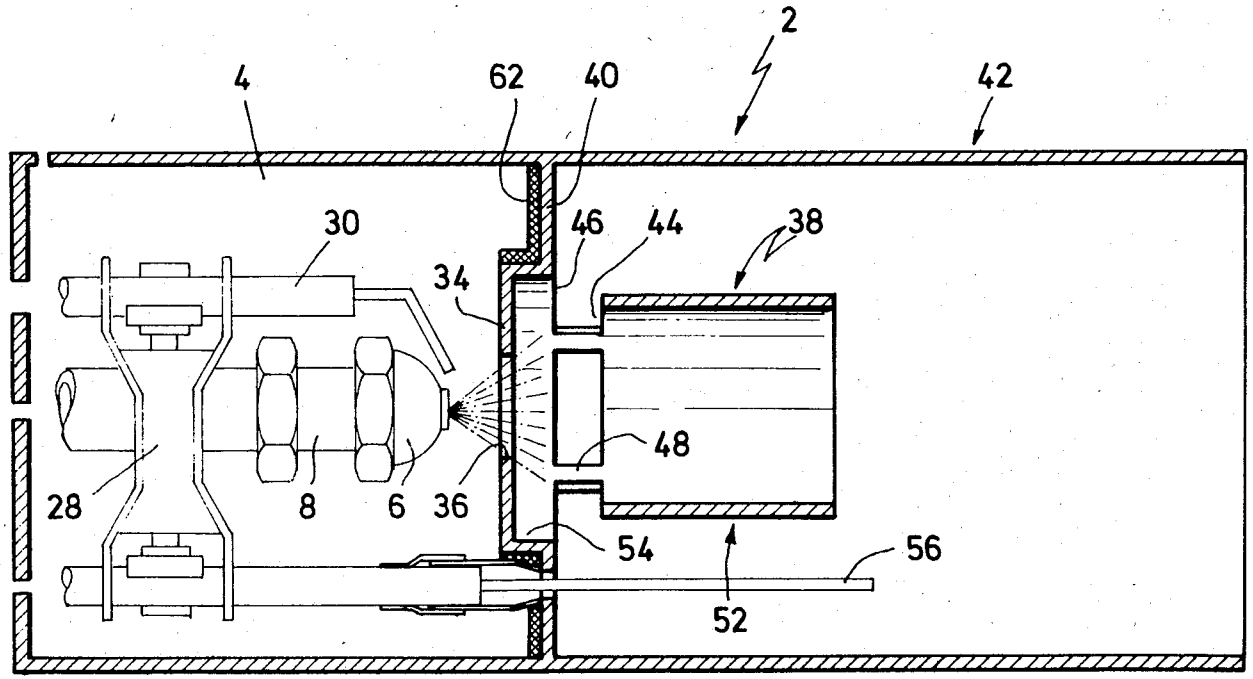
FIG. 2 is a view similar to that of FIG. 1 of a modified exemplary embodiment of an oil gasifying burner in a simplified representation.

The exemplary embodiment of FIG. 2 differs from that of FIG. 1 merely in the shape of the end wall 40 and of the mixing tube portion 50 between the end wall and the radial passage 44. The corresponding parts are referred to with the same reference numerals.

In the exemplary embodiment of FIG. 2, the inside diameter of the mixing tube portion 50 is selected greater than that of the mixing tube portion 52. Besides, the end wall 40 surrounding the mixing tube portion 50 is offset downstream such that it is coplanar with the upstream limitation 46 of the radial passage 44. Thus, the formation is prevented of a dead space 60 surrounding the mixing tube portion 50 of the exemplary embodiment of FIG. 1.

Additionally, the end wall 40 supports at its surface facing chamber 4 a thermally insulating layer 62 whose material and thickness are so selected that the temperature of the end wall 40 guarantees a minimal soot deposition at the end wall 40.

Of course, in the embodiment of FIG. 2 it is equally possible to vary the inside diameter and the axial extension of the mixing tube section 50 so that even in this embodiment the volume and shape of the dead space 54 can be optimally adjusted to suit the operational conditions.

Conversely, it is also possible in the embodiment of FIG. 1 to cover the end wall 40 at its side turned to the chamber 4 with an insulation layer 62.

We claim:

1. An oil gasifying burner comprising an oil atomizing device, a combustion air supply means surrounding the oil atomizing device and having an end wall extending radially inwardly, a shield supported by said end wall and disposed downstream of the outlet of the oil atomizing device, said shield having a shield opening therethrough, a mixing tube, co-axial with the shield opening, and disposed downstream of the shield opening, wherein the mixing tube comprises an upstream portion adjoining the shield, said upstream portion having an upstream end and a downstream end, and a downstream portion connected to said upstream portion through a radial passage, wherein said upstream portion comprises a solid wall between said shield and said radial passage, wherein the axial length of said solid wall is between 0.1-multiple to 0.6-multiple of the inner diameter of the downstream portion of the mixing tube, a substantially cylindric flame tube whose upstream end is sealingly connected with the end wall of the combustion air supply means, wherein the mixing tube is positioned within said flame tube in an annularly spaced relationship thereto.

2. An oil burner according to claim 1, wherein the end wall is between the mixing tube and the flame tube and positioned downstream of the shield.

3. An oil burner according to claim 2, wherein the end wall is co-planar with the upstream end of the radial passage.

4. An oil burner according to claim 1 wherein the inside diameter of the upstream portion of the mixing tube does not equal the inside diameter of the downstream portion of the mixing tube.

5. An oil burner according to claim 4 wherein the inside diameter of the upstream portion of the mixing tube is greater than the inside diameter of the downstream portion of the mixing tube.

6. An oil burner according to claim 1 wherein the end wall is provided with a heat insulation layer at the surface of the end wall facing the combustion air supply means.

* * * * *